United States Patent [19]

Youd

[11] 4,037,439

[45] July 26, 1977

[54] KEY HOLDING APPARATUS

[76] Inventor: James D. Youd, 113 Metcalf Road, N. Attleboro, Mass. 02760

[21] Appl. No.: 662,354

[22] Filed: Mar. 1, 1976

Related U.S. Application Data

[63] Continuation-in-part of Ser. No. 584,694, June 6, 1975.

[51] Int. Cl.[2] ..... A47G 29/10
[52] U.S. Cl. ..... 70/456 R
[58] Field of Search ..... 70/456–459, 70/414; 150/40; 24/3 K

[56] References Cited

U.S. PATENT DOCUMENTS

| | | | |
|---|---|---|---|
| 1,161,529 | 11/1915 | Ringer | 70/456 R |
| 1,948,358 | 2/1934 | Reil | 70/456 R |
| 2,596,716 | 5/1952 | Otten | 70/456 R |
| 2,708,073 | 5/1955 | Mohylowski | 240/6.4 |
| 2,908,156 | 10/1959 | Preston | 70/414 X |
| 2,955,704 | 10/1960 | Carrington | 70/456 R |
| 3,279,513 | 10/1966 | Henderson | 70/456 R X |

FOREIGN PATENT DOCUMENTS

| | | | |
|---|---|---|---|
| 2,107,846 | 3/1972 | Germany | 70/456 R |
| 424,172 | 8/1947 | Italy | 70/456 R |

*Primary Examiner*—Robert L. Wolfe
*Attorney, Agent, or Firm*—John A. Haug

[57] ABSTRACT

A case for holding keys is shown comprising a flat, round base having a plurality of key receiving stations spaced around the member. The base may be rotatably disposed within a housing having integral top, bottom and side walls and a key access slot formed in a portion of the top, bottom and side walls so that any selected key station can be brought into alignment with the key access slot. In one embodiment means are provided for mounting the case on a chain as a pendant and the top wall is annular in configuration leaving exposed the central portion of the facing base and esthetic design thereon. Another embodiment useful as a pendant includes a cover overlying the top wall and hinged thereto. In yet another embodiment the case comprises a generally circular base without a surrounding housing, the base being provided with the usual key receiving stations on one or both faces and each station being provided with a key retractor.

12 Claims, 19 Drawing Figures

KEY HOLDING APPARATUS

This application is a continuation in part of copending application Ser. No. 584,694, filed June 6, 1975.

This invention relates to key holders and more particularly to apparatus for holding a plurality of keys and for providing access to a group of keys only one at a time.

Although there are many types of key holders available in the marketplace each has limitations in its use, suitability and appeal. There is always a need for a key case which overcomes shortcomings of the prior art. Some problems not satisfactorily solved in the prior art include the tendency for keys to become entangled in a holder when a plurality of them are mounted therein, and the fact that the size and configuration of the holder has not been optimized, that is, either the holder has been unduly bulky so that it forms a bulge when placed in the pocket of an article of apparel or it has been so small that it is difficult to find, particularly in the dark when disposed in a typical handbag. Additionally, many key holders are lacking in esthetic appeal for individuals who desire to have something distinctive as well as attractive.

It is therefore an object of the invention to provide a key holder capable of mounting a plurality of keys without danger of entanglement of the keys.

Another object of the invention is the provision of a keyholder which is of optimum size and configuration, one which is not bulky yet is readily distinguishable by touch to facilitate ready discrimination between it and other articles.

Yet another object of the invention is the provision of a keyholder which is inexpensive yet reliable and esthetically appealing.

Various additional objects and advantages of the present invention will become readily apparent from the detailed description and accompanying drawings.

Briefly the above objects are realized by providing a generally flat circular housing having an integral top, bottom and side walls, the housing formed with a key access slot extending through a portion of the top, bottom and side wall. A generally flat base member is rotatably mounted within the housing and provided with a plurality of key receiving pockets on one or two sides thereof. A unique pivoting frame is provided which allows disposition of keys through the center of rotation of the base member. Windows are provided in the housing so that indicia placed on the base member can be discerned by the user to identify the key aligned with the key access slot. In certain embodiments means are provided for mounting the case as a pendant. A separate hinged cover overlies the top wall in one embodiment while in another the wall is cut away to expose a design on the underlying base member. Yet another embodiment comprises a circular base member without a surrounding housing but provided with key retracting means.

In the accompanying drawings in which several of the preferred embodiments of the invention are illustrated:

Figure 1:
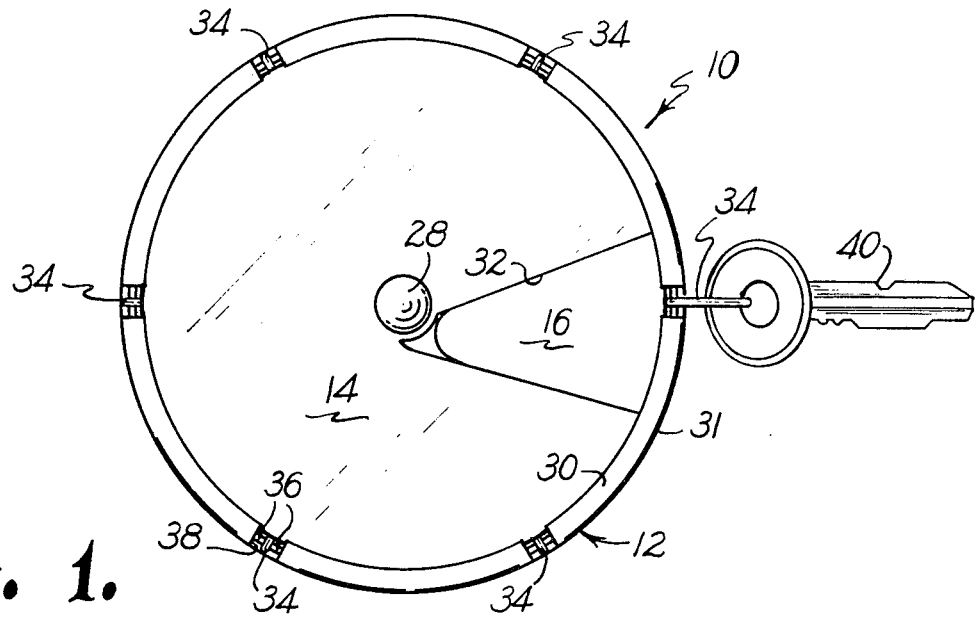
FIG. 1 is a top plan view of a keycase made in accordance with the invention showing a key extending from the keycase ready for use.

Dimensions of certain parts as shown in the drawing may have been modified or exaggerated for the purpose of clarity of illustration.

Figure 3:
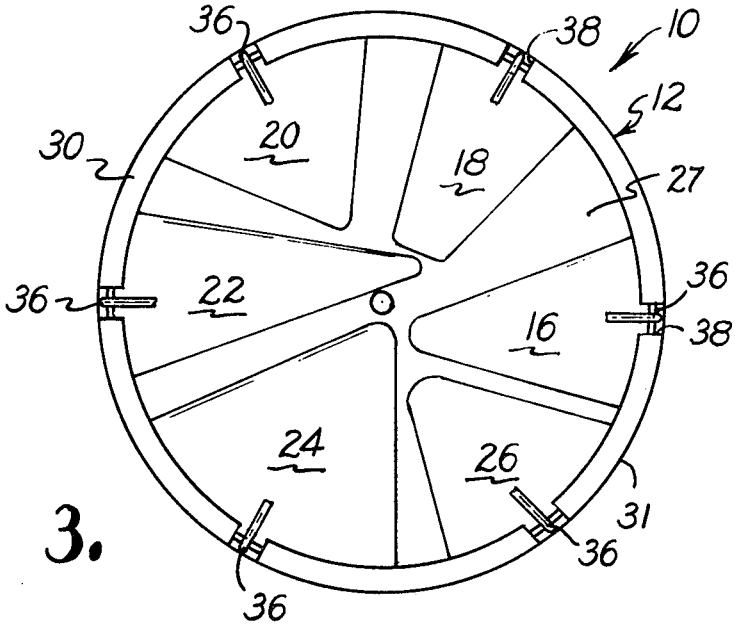
FIG. 3 is a view similar to FIG. 1 but with the rotatable cover removed and without keys showing key receiving recesses or stations in the base member.

Referring now to the drawings, numeral 10 indicates a keycase made in accordance with the invention comprising a flat, generally round base member 12 having a bottom 13 and a rotatable cover 14 disposed thereon. As seen in FIG. 3 a plurality of key receiving generally wedge shaped recesses or stations 16–26 are provided in the base member in any convenient manner, as by molding them in the base member. The cover 14 rests on land area 27 and is rotatably mounted thereon as by utilizing a centrally located pin 28. Base member 12 is provided with a lip 30 extending inwardly from side wall 31 to capture the outer peripheral portion of cover 14. Alternatively, if desired, lip 30 could be formed integrally with cover 14 to capture the outer peripheral portion of base member 12. If desired, cover 14 can be rotatably mounted using lip 30 without the necessity of center pin 28. Cover member 14 is provided with a key access slot 32 so arranged that upon rotation of cover 14 the slot can be aligned with any selected key receiving station 16–26.

A plurality of lockable hooks 34 are pivotably mounted adjacent the outer periphery of the base on pins 36 arranged in slots formed in base 12 so that a key 40 mounted on a hook 34 can be pivoted out of a selected recess 16–26 when slot 32 is aligned with the recess.

It should be noted that recesses 16–26 may be of different sizes to accomodate different sized keys and that the radial depth or longitudinal axes of certain of the recesses, for example recess 22, that is the length extending from the innermost to the outermost portions of the recess, can exceed the radius of the base member thereby enabling the mounting of longer keys without increasing the overall dimensions of the keycase.

Figure 2:
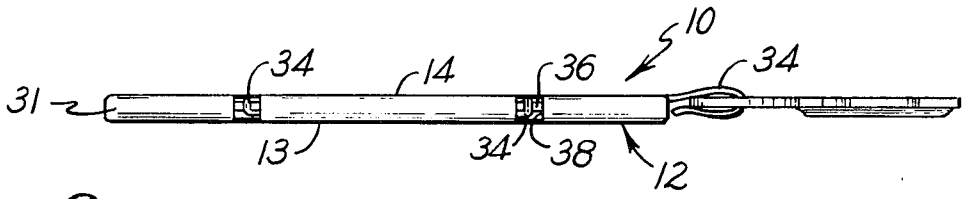
FIG. 2 is a front elevational view of the FIG. 1 keycase.
Figure 4:
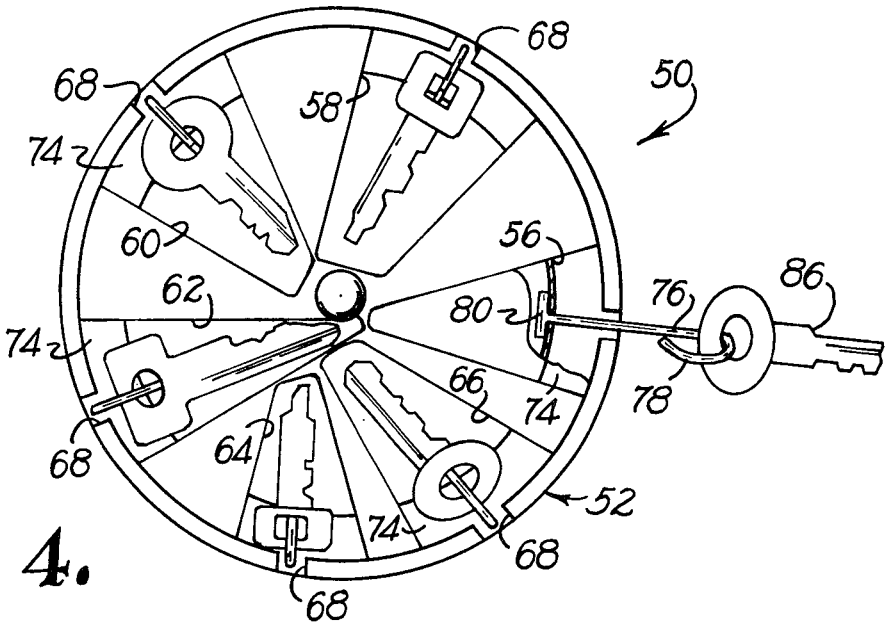
FIG. 4 is a top plan view of a second embodiment of the invention with the cover removed and with portions broken away for purposes of illustration.
Figure 5:
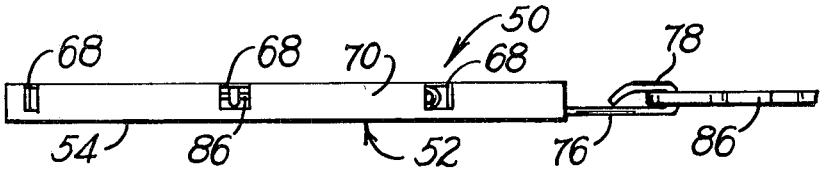
FIG. 5 is a front elevational view of the FIG. 4 embodiment.
Figure 6:
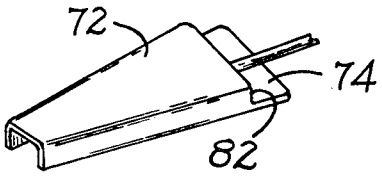
FIG. 6 is a perspective view of a retainer plate.

A second embodiment 50 is shown in FIGS. 4–6 which comprises a base member 52 similar to base member 12 of FIGS. 1–3. Base member 52 is provided with a bottom 54 and a cover (not shown) similar to cover 14 in FIG. 1.

Recessed key receiving stations 56–66 are formed in base member 52 and a slot 68 is provided in side wall 70 in alignment with each recessed key receiving station. Also mounted in each key receiving station is a retainer plate 72 of a configuration matching the respective recess and having a step portion 74. An elongated key holding member 76 having a lockable hook 78 either integral with or attached to one end and tab portion 80 at the opposite end extends through an aperture in wall 82 of plate 72.

Figure 7:
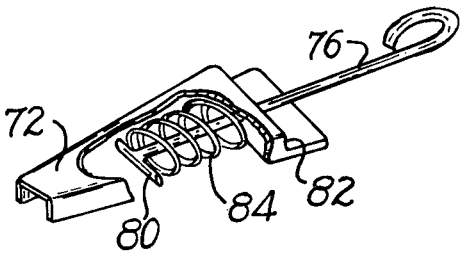
FIG. 7 is a perspective view, partly broken away, of a modification of the retainer plate arrangement shown in FIG. 6.

The cover is rotated until the access slot is aligned with the key which is desired for use, the key is flipped out of the recess and member 76 is drawn radially outwardly to permit ready handling of the key. Outward movement of elongated member 76 is limited by the engagement of tab 80 with wall portion 82 of retainer plate 72. If desired a return spring 84 as seen in FIG. 7 can be interposed between wall portion 82 and tab 80 to provide automatic retraction of the key into the key receiving station.

Figure 8:
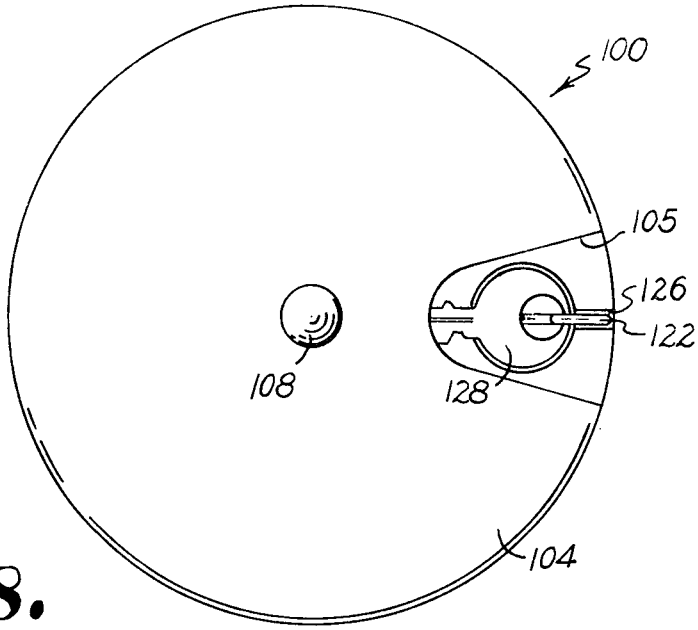
FIG. 8 is a top plan view of another embodiment of the invention.
Figure 9:
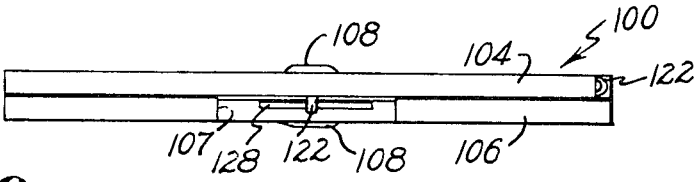
FIG. 9 is a front elevational view of the FIG. 8 embodiment.
Figure 10:
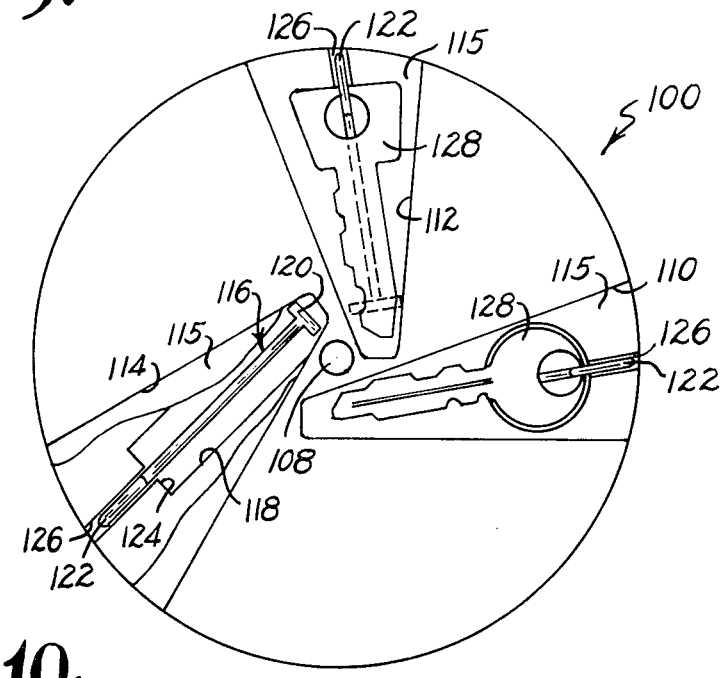
FIG. 10 is a view similar to FIG. 8 but with the top cover removed and with a portion broken away to show key retaining means.

FIGS. 8–10 shown a double sided keycase 100 similar to that shown in previous Figures but provided with key receiving recessed stations on both sides of a base member 102. Keycase 100 comprises top and bottom covers 104, 106 with a respective key access slot 105, 107 rotatably mounted on centrally located pin 108. As seen in FIG. 10 three stations 110, 112 and 114 are shown although the particular number of stations provided is a matter of choice. It will be noted that the three stations shown all have a longitudinal axis which exceeds the radius of the base member to accomodate long keys. Key retaining means is mounted at each station in a manner similar to that shown in the Figure 4–6 embodiment. An elongated key holding member 116 is disposed in a channel 118 located in the base member beneath floor 115 of a respective station and is adapted to move generally radially inwardly and outwardly. Key holding member 116 is provided with tab 120 at one end and a lockable hook 122 either integral with or attached to its opposite end. Tab 120 limits outward movement of member 116 by engagement with wall 124 of channel 118. Floor 115 of each station is provided with a cut portion 126 to permit elongated key holding member to move radially inwardly within the cover member.

In order to use key case 100, cover 104 or 106 is rotated until the desired key is aligned with the key access slot 105 or 107. The selected key 128 and hook 122 are grasped and pulled outwardly until the innermost portion of the key is clear of the cover and then the key is flipped out of the recess and is ready for use. Slot 105 is shown having a radial depth which is shorter than slot 32 of key case 10 of FIGS. 103 since the key holder can be moved radially outwardly before the key is pivoted out of the recess.

Figure 11:
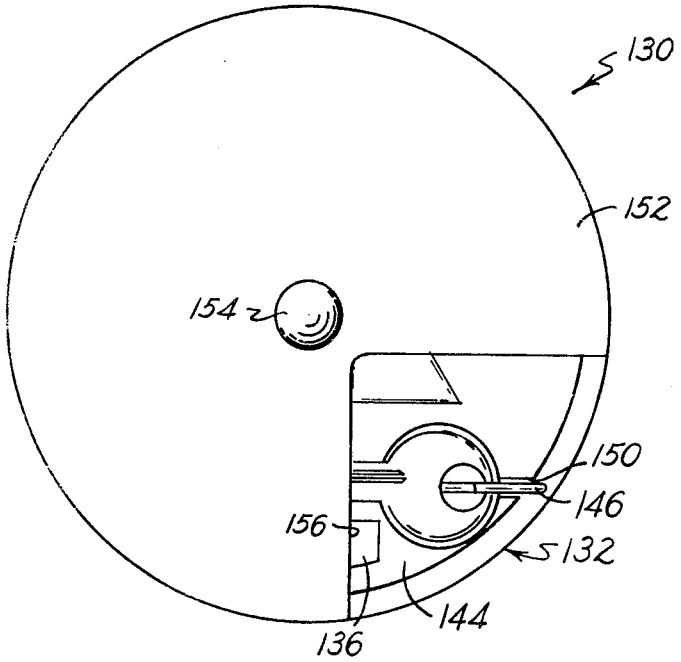
FIG. 11 is a top plan view of yet another embodiment of the invention.
Figure 12:
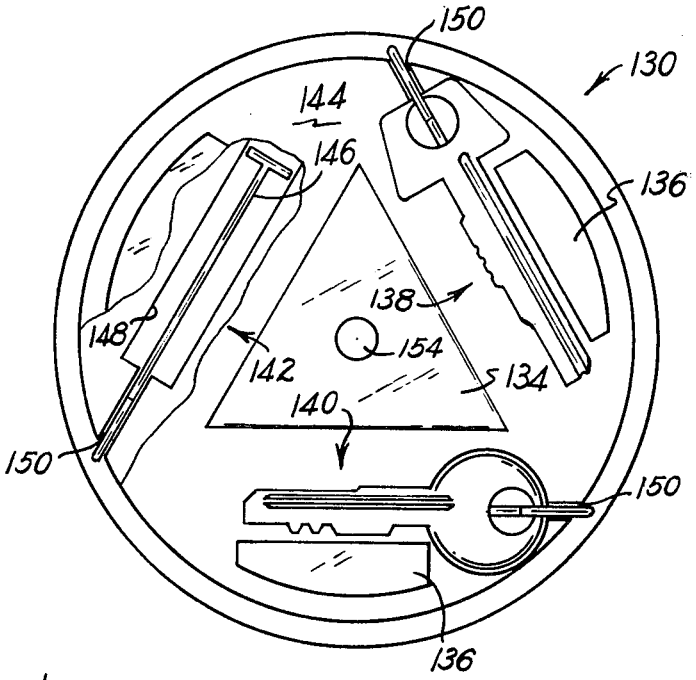
FIG. 12 is a view similar to FIG. 11 but with the cover removed and with a portion broken away to show key retaining means.
Figure 14:
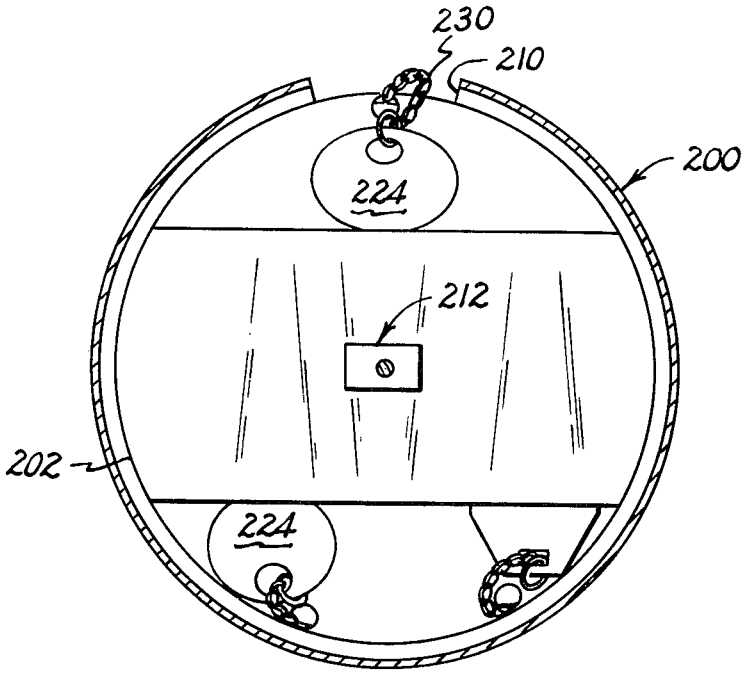
FIG. 14 is a cross sectional view taken on line 14—14 of FIG. 13.
Figure 13:
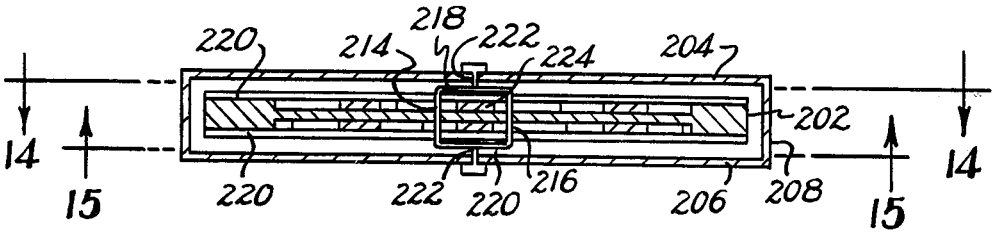
FIG. 13 is a cross sectional view taken on line 13—13 of FIG. 16 of yet another embodiment.
Figure 15:
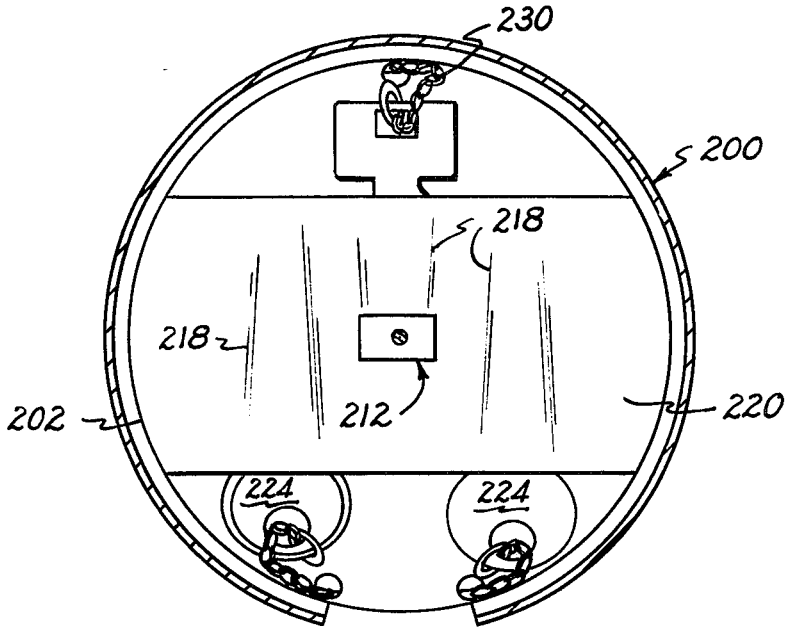
FIG. 15 is a cross sectional view taken on line 15—15 of FIG. 13.

Another keycase 130 is depicted in FIGS. 11 and 12 which differs from the previous embodiments primarily in that the key receiving stations have a longitudinal axis which extends along a chord of the round base member rather than extending generally radially. Base member 132 is provided with raised land portions 134,136 defining key receiving pockets 138,140,142 therebetween. Base member 132 is provided with a floor 144 which in FIG. 12 is broken away in part to show elongated key holder 146 in channel 148 of base member 132. Key holder 146 is essentially identical with that shown in FIGS. 8–10 to which reference may be had for a more detailed description. Floor 144 is cut out at 150 to permit movement of the key holder within the outer periphery of the base member 132. Cover 152 is rotatably mounted at pin 154 on base member 132 and is provided with key access slot 156. Thus a user merely grasps the selected key and holder 146, pulls it outwardly until the key clears the cover and pivots the key out of the station ready for use.

FIGS. 13–16 illustrate an embodiment 200 in which the base member 202 is disposed within a housing formed of integrally attached top 204, bottom 206, and side wall 208 therebetween. Key access slot 210 is formed in a portion of the top, bottom and side wall. Base member 202 is rotatably mounted relative to the housing by means of pivotable frame 212 comprising spaced upstanding legs 214,216 extending through the base member and joined together by laterally extending arms 218,220. Pivot pins 222 extend from arms 218,220 in a direction away from legs 214,216.

Base member 202 is formed with a plurality of key receiving stations or pockets 218 formed therein. Although pockets are shown on both top and bottom sides of the base member it will be understood that they may be provided on one side only if so desired. Further, the specific number of stations employed is a matter of choice.

Retainer member 220 is attached to the top and bottom sides of base member 202 and conveniently retains respective keys in their pockets. The keys are preferably attached to the base member by any convenient means such as by chain 230. A clip at the end of each chain may be used to attach a key.

It will be noted that the spaced upstanding legs 214,216 of pivotable frame 212 not only fix the frame relative to the base member 202 but also permit locating a key 224 so that it passes through the center of rotation of the base member thus allowing optimum utilization for key storage of the surface area of base member 202. Should it be desired to store an odd number of keys (i.e., three) on a side, it will be understood that it may be preferred to use the pivotable pin shown in FIGS. 1–12 if it is not necessary to dispose a key so that it coincides with the center of rotation of the base member.

Figure 16:
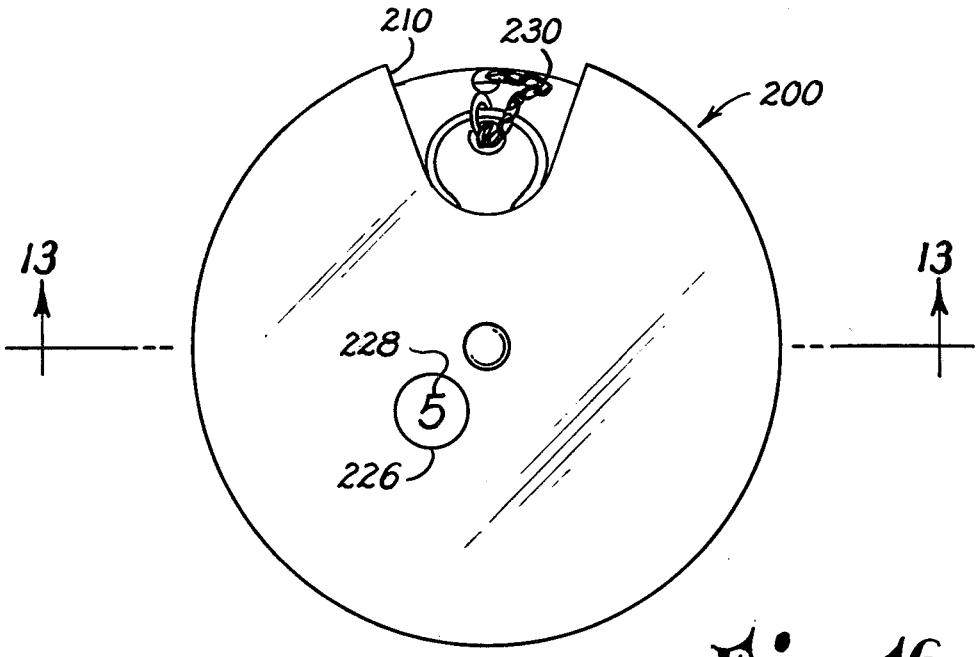
FIG. 16 is a top plan view of the FIG. 13–15 embodiment.

As seen in FIG. 16 a window 226 may be provided in the housing top (and/or bottom) and selected indicia 228 so located on base member 202 that ready identification is provided of the key receiving pocket 218 and hence its respective key, which is aligned with key access slot 210. The indicia may be in the form of numbers, as shown, or alternatively letters, colors or other comparable means.

Pockets 218 are so located on base member 202 that only one key receiving pocket may be fully aligned with the key access slot 210 at any given time thus preventing entanglement and confusion over the selected key.

In order to use case 200 the user merely grasps base member 202 and rotates it relative to the housing until the desired key receiving pocket is aligned with the key access slot, as indicated for instance by indicia 228, and then pulls the selected key 224 from its respective pocket.

Figure 17:
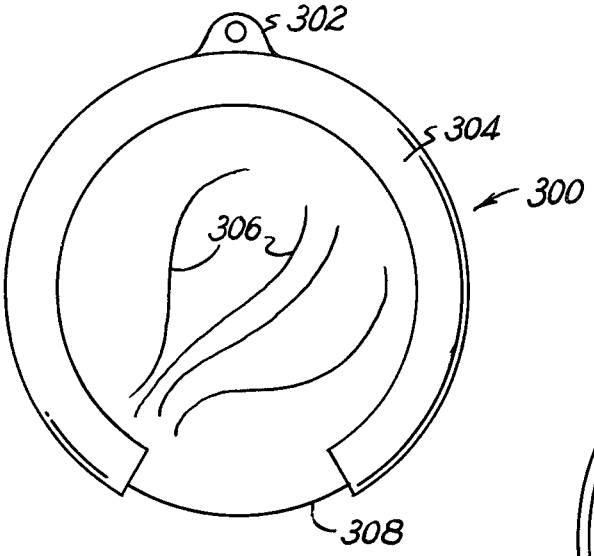
FIG. 17 is a top plan view of another embodiment of the invention.
Figure 18:
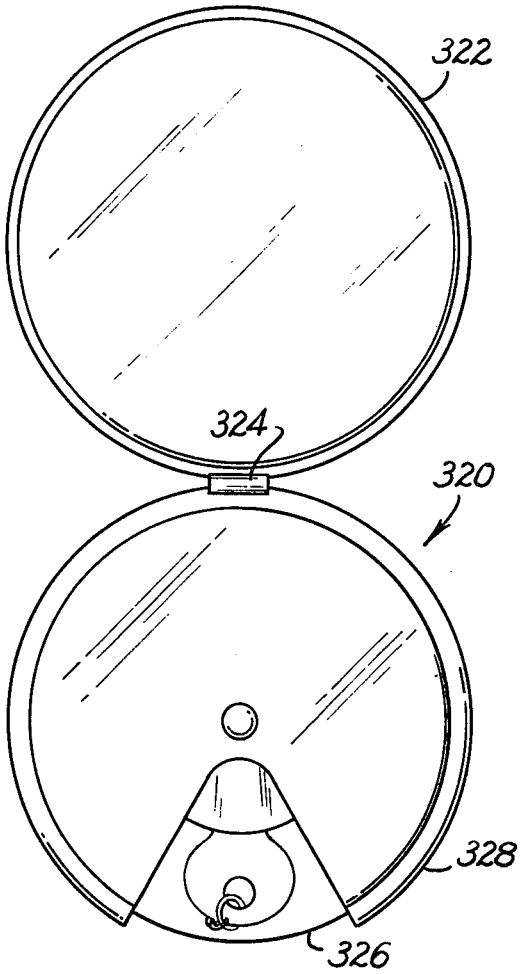
FIG. 18 is a top plan view of yet another embodiment of the invention.

With particular reference to FIGS. 17 and 18 to key case is provided with means to use it as a pendant. In FIG. 17 key case 300 is provided with mounting tab 302 to which a chain can be attached. Top wall 304 is shown in an annular configuration so that a desired esthetic, artistic design 306 disposed on base member 308 is exposed. Alternatively key case 320 of FIG. 18 is provided with cover 322 pivotably attached to key case 320 by hinge 324. Cover 322 is adapted to overlie base member 326 and housing 328 and may be provided with a suitable decorative design on its external surfaces.

Figure 19:
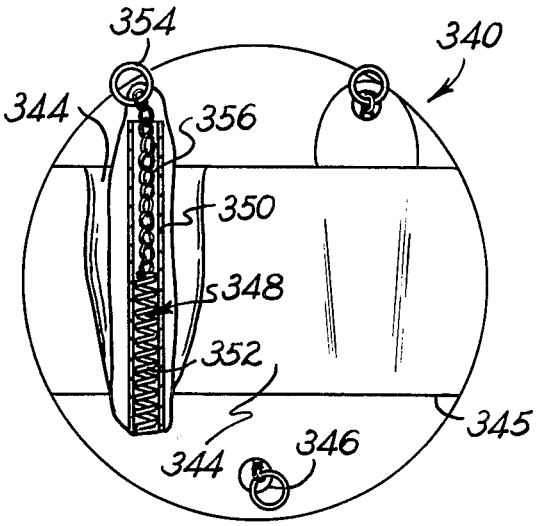
FIG. 19 is a top plan view, with parts broken away of another embodiment of the invention.

FIG. 19 depicts keycase 340 comprising a base member 342 which may be used without a surrounding housing. Keycase 340 has a plurality of key receiving stations 344 formed with an overlying element 345. An aperture 346 which leads into the interior of base member 342 is located adjacent each key receiving station to provide access for key retracting means 348. Preferably a channel 350 runs along the length of each key receiving station and is located in the interior of the base member. Biasing means which may be in the form of a spring 352 is attached at one end to the base member and extends within the channel 350 and is attached to a key receiving clip 354 either directly or through a chain 356. The spring 352 places a bias on the clip 354 (and concomitantly on a key attached thereto) tending to maintain the clip contiguous to the aperture and an attached key within its respective station. If a key is removed from the station for use of a force is applied to the key so that returning the key to its seat in the station is facilitated. In some cases it may not be necessary to use channel 350; however, it is usually preferred since the channel ensures unencumbered operation of the biasing means.

Thus it will be seen that a key case has been described which achieves the objects of the invention, is economical to produce yet is efficient. Further the key case is of a configuration which is easily identified by touch even when in the midst of many other objects as when disposed in a lady's handbag, without being bulky.

Although the invention has been described with respect to certain specific preferred embodiments thereof, many other variations and modifications will immediately become apparent to those skilled in the art. It is therefore the intention that the appended claims be interpreted as broadly as possible in view of the prior art to include all such variations and modifications.

I claim:

1. A key case comprising a. a generally flat circular housing having a top, a bottom and a side wall extending therebetween, b. a generally flat circular base member disposed within the housing, the base member formed with a plurality of key receiving pockets formed in the base member, and c. means rotatably mounting the base member relative to the housing, whereby the base member may be grasped and rotated to bring a selected key receiving slot into alignement with the slot.

2. A key case according to claim 1 in which the means rotatably mounting the base member relative to the housing includes two spaced upstanding legs joined together by laterally extending arms, the legs extending through the base member on opposite sides of a key receiving pocket and a pivot pin attached to each arm and extending away from the legs.

3. A key case according to claim 1 in which the key receiving pockets are disposed on two opposite sides of the base member.

4. A key case according to claim 3 in which the base member has an outer periphery and the pockets are aligned with different portions of the periphery so that only one full key receiving pocket will be aligned with a key access slot at any given time.

5. A key case according to claim 1 in which keys are attached to the base member by chains.

6. A key case according to claim 1 in which a window is formed in the housing and selected indicia are so located on the base member so that a key receiving pocket can be identified when it is aligned with the key access slot.

7. Key case apparatus comprising a. a generally flat base member formed with generally flat first and second opposed surfaces, a layer overlying at least one of said first and second surfaces, the layer having a plurality of openings formed between said one surface and said layer to form a plurality of key receiving pockets therein, the pockets located in the base member so that keys disposed therein extend in more than a single direction, b. key mounting means disposed at each pocket, and c. retracting means mounted on the base at each pocket and operatively connected to the key mounting means, the retracting means applying a biasing force tending to move the key mounting means toward their respective pockets.

8. Key case apparatus according to claim 7 further including channel means mounted on the base member at each pocket, the retracting means comprising an elongated biasing member trained through each channel means.

9. Key case apparatus according to claim 1 including chain mounting means disposed on the housing.

10. key case apparatus according to claim 9 including a lip overlying the top wall of the housing and pivotably mounted thereto.

11. Key case apparatus according to claim 7 in which the outer peripheral margin of the base member is generally circular in configuration.

12. Key case apparatus according to claim 7 in which the flat base member is not significantly thicker than the keys mounted therein.

* * * * *